US005080092A

United States Patent [19]

Tenna

[11] Patent Number: 5,080,092

[45] Date of Patent: Jan. 14, 1992

[54] PROTECTIVE MASK

[75] Inventor: Giovanni M. Tenna, Munich, Fed. Rep. of Germany

[73] Assignee: SGE Societa Generale Elastomeri S.p.A., Italy

[21] Appl. No.: 483,963

[22] Filed: Feb. 9, 1990

Related U.S. Application Data

[63] Continuation of Ser. No. 227,157, Aug. 2, 1988, abandoned.

[30] Foreign Application Priority Data

Aug. 4, 1937 [CH] Switzerland ..... 02981/87

[51] Int. Cl.[5] ..... A62B 18/08

[52] U.S. Cl. ..... 128/201.19; 128/206.24

[58] Field of Search ..... 128/201.19, 201.24, 128/205.27, 206.21, 206.24, 207.12

[56] References Cited

U.S. PATENT DOCUMENTS

| | | | |
|---|---|---|---|
| 1,710,160 | 4/1929 | Gibbs | 128/206.24 |
| 1,762,695 | 6/1930 | Monro | 128/201.19 |
| 1,975,797 | 10/1934 | Montuori | 128/206.24 |
| 2,038,267 | 4/1936 | Bullard | 128/201.19 |
| 2,326,650 | 8/1943 | Husted | 128/201.19 |
| 2,444,417 | 7/1948 | Bierman | 128/201.19 |
| 2,910,062 | 10/1959 | Potash | 128/201.10 |
| 2,974,665 | 3/1961 | Motsinger | 128/201.19 |
| 3,540,442 | 11/1970 | Holloway | 128/201.19 |
| 4,069,516 | 1/1978 | Watkins, Jr. | 128/206.24 |
| 4,440,163 | 4/1984 | Spergel | 128/205.13 |
| 4,449,524 | 5/1984 | Gray | 128/202.27 |
| 4,595,003 | 6/1986 | Shoemaker et al. | 128/201.19 |
| 4,616,647 | 10/1986 | McCreadie | 128/206.19 |
| 4,677,976 | 7/1987 | Fujinuma et al. | 128/201.25 |
| 4,702,243 | 10/1987 | Smith | 128/205.24 |
| 4,905,683 | 3/1990 | Cronjaeger | 123/206.24 |

FOREIGN PATENT DOCUMENTS

| | | | |
|---|---|---|---|
| 748021 | 3/1944 | Fed. Rep. of Germany | 128/206.24 |
| 1535622 | 8/1968 | France | 128/201.19 |
| 0540757 | 10/1941 | United Kingdom | 128/201.19 |

OTHER PUBLICATIONS

Spriomask—Masque A Champ Visuel Integral.
Sabre Brigade—Positive Pressure Compressed Air Breathing Apparatus.
Maschera Antigas C.607.
Tesimax—Schutzkleidung Atemschutztechnik, Vollmaske TR 82.
Comesa, Autorespiratore ad Aria Compressa Safelife.
European Rubber Journal, Jun. 1988, Elastomers in Defence By Robert Grace, ERJ Staff.
M 90.
NBC Respirators.

*Primary Examiner*—Edgar S. Burr
*Assistant Examiner*—Aaron J. Lewis
*Attorney, Agent, or Firm*—Brumbaugh, Graves, Donohue & Raymond

[57] ABSTRACT

The protective mask (1) comprises essentially a face-shield (2) covering the user's face, made by rigid, resilient and transparent material and rimmed by a bellows seal; the belts (4), the operational means interfacing to the outside world, the filters, the ocular surfaces (12) and the other elements with which the mask is provided are fitted to the rigid structure of the face-shield (2) which does not transmit the possible deformations due to the weight of the means to the seal (11); said seal (11) provided only the necessary tightness with high comfort allowing the continuous use of the mask even during many consecutive days and nights (see FIG. 3).

6 Claims, 3 Drawing Sheets

PROTECTIVE MASK

This application is a continuation of application Ser. No. 227,157, filed on Aug. 2, 1988, now abandoned.

BACKGROUND OF THE INVENTION

The present invention refers to protective mask. The traditional protective masks, usually called "gas masks", comprise essentially a rubber face-shield, associated to means to fit it to the user's head. This face-shield carries the devices necessary to the breathing, to the feeding and some other ones, together with an ocular surface, which can be realized by one or two separate elements.

Therefore the face-shields are structured in such a way that they are strong enough to withstand the stresses due to the weight of the transparent surface and of the remaining devices necessary to the operation of the mask. At the same time they have a deformable edge, able to follow the configuration of the face, assuring the required tightness without prejudice to the comfortable use of the mask.

Therefore the current masks are realized trying to mediate the opposite requirements of stiffness and of tightness and comfort, which are obviously in contrast. Moreover the transparent surfaces of said masks are often of reduced extension limiting the width of the field of view; whenever they are wide, they show a concave development which compromises the use of optical devices as for instance binoculars or similar.

SUMMARY OF THE INVENTION

The object of the present invention is essentially to provide a protective mask structured in a way to avoid the above mentioned drawbacks.

This object is achieved by a protective mask comprising a face-shield associated to means for the fit to the user's head and to operational means interfacing to the outside world. The face-shield shows at least one transparent ocular surface, characterized by the fact that the face-shield and the ocular surface are made of rigid material. The face-shield has a perimetric edge to which means are secured for sealing the shield to the face of the wearer and for adjusting the tightness on the user's face.

The advantages obtained by the present invention consist essentially in the fact that the face-shield is able to bear, without deformation, the mechanical load coming from the weight of the ocular surface and of the operational means interfacing to the outside world which comprise the devices necessary to the operation of the mask. The tightness means associated to its edge must not be affected by these loads, but just provide the tightness with a particularly high degree of comfort allowing the use of the mask even during many consecutive days and nights.

Further advantages are the following:

- the availability of a mask offering a wide field of view pratically coincident with that of the bare face;
- the possibility to use, while wearing the mask, the usual optical instruments, particularly binoculars;
- the possibility to use for the realization of the tightness means rubbers of particularly antiallergic and soft compound;
- the possibility of replacing the tightness means in case of wear;
- a better protection of the face, because the face-shield is made of rigid material.

BRIEF DESCRIPTION OF THE DRAWINGS

The invention will be described in the following in more detail on the basis of an example of realization as shown in the attached drawings.

DESCRIPTION OF THE PREFERRED EMBODIMENT

Figure 2:
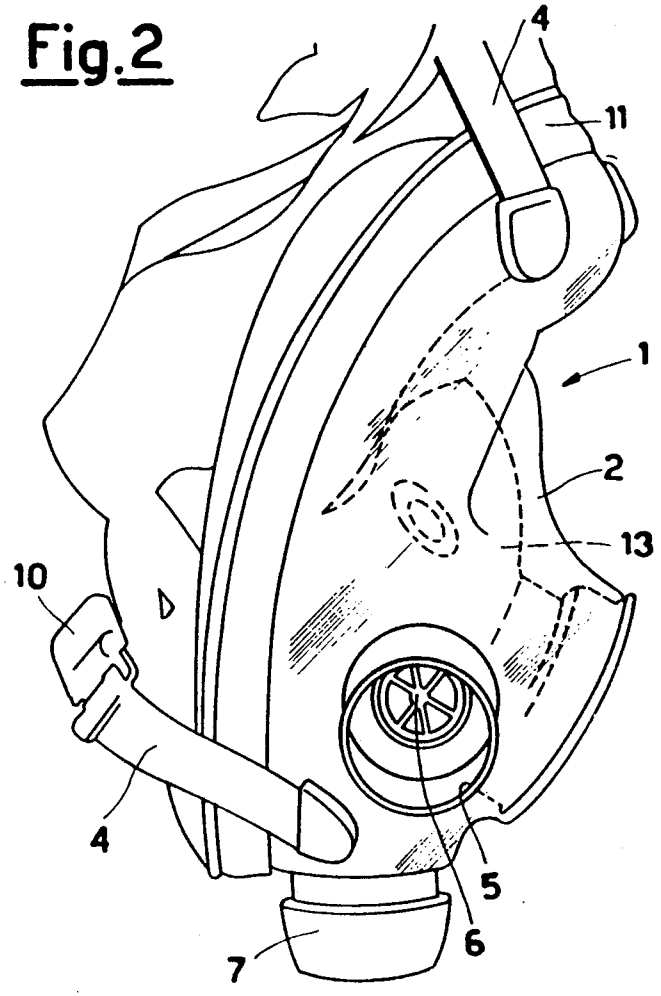
FIG. 2 is a side view of the mask
Figure 1:
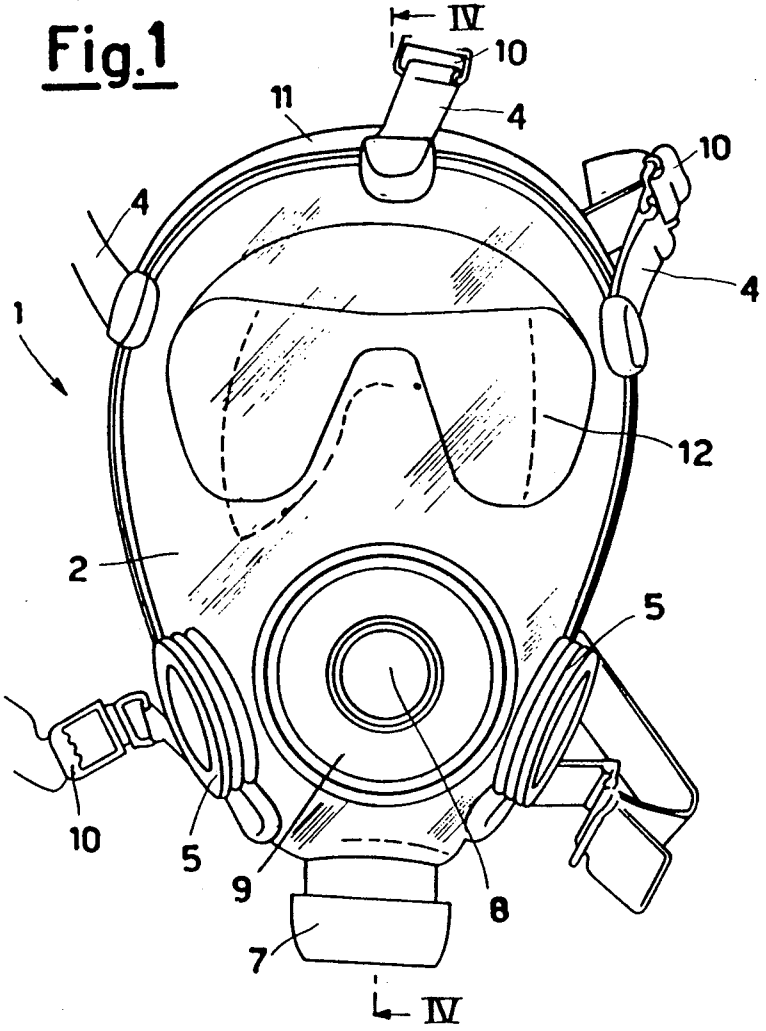
FIG. 1 is a frontal view of the mask
Figure 3:
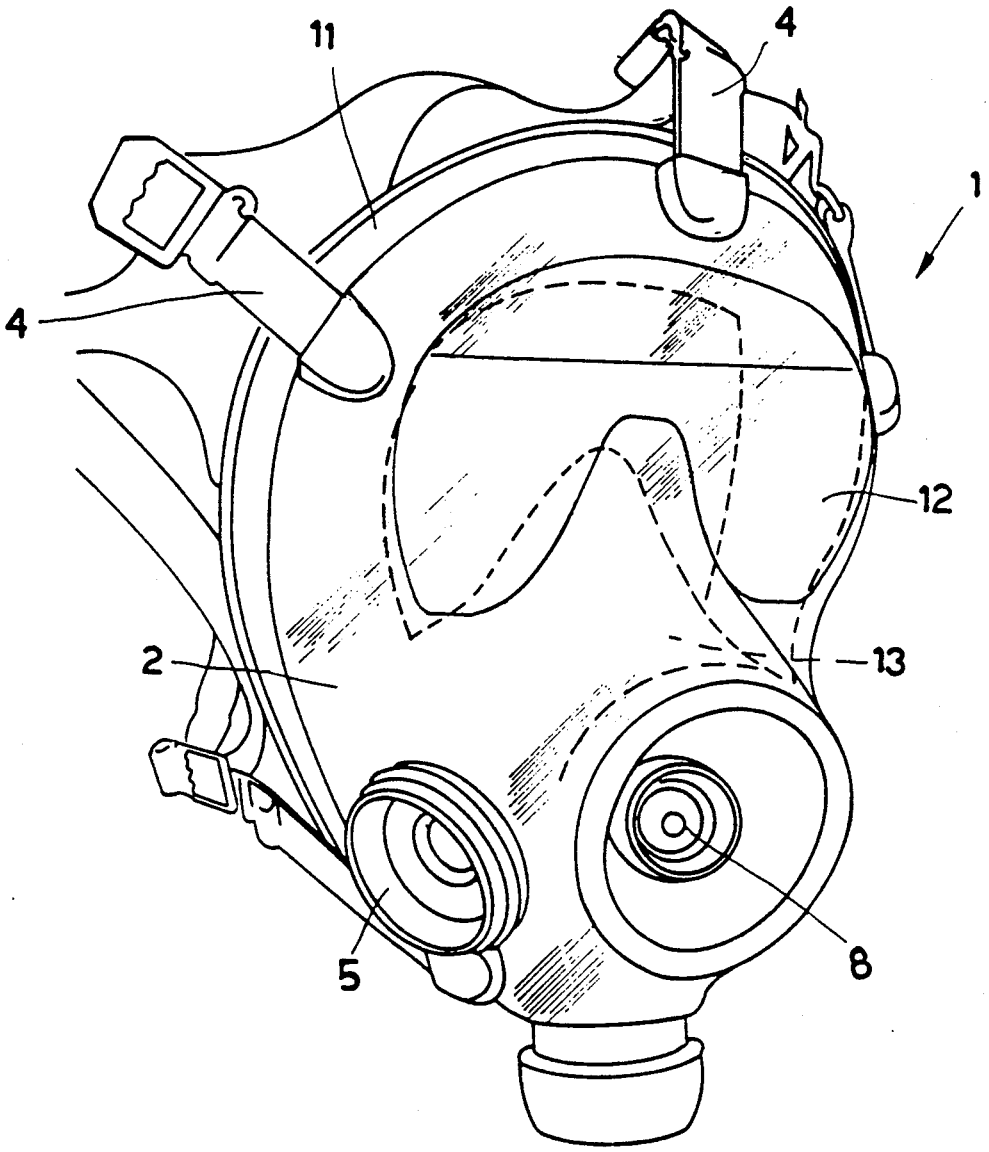
FIG. 3 is a perspective view of the mask
Figure 4:
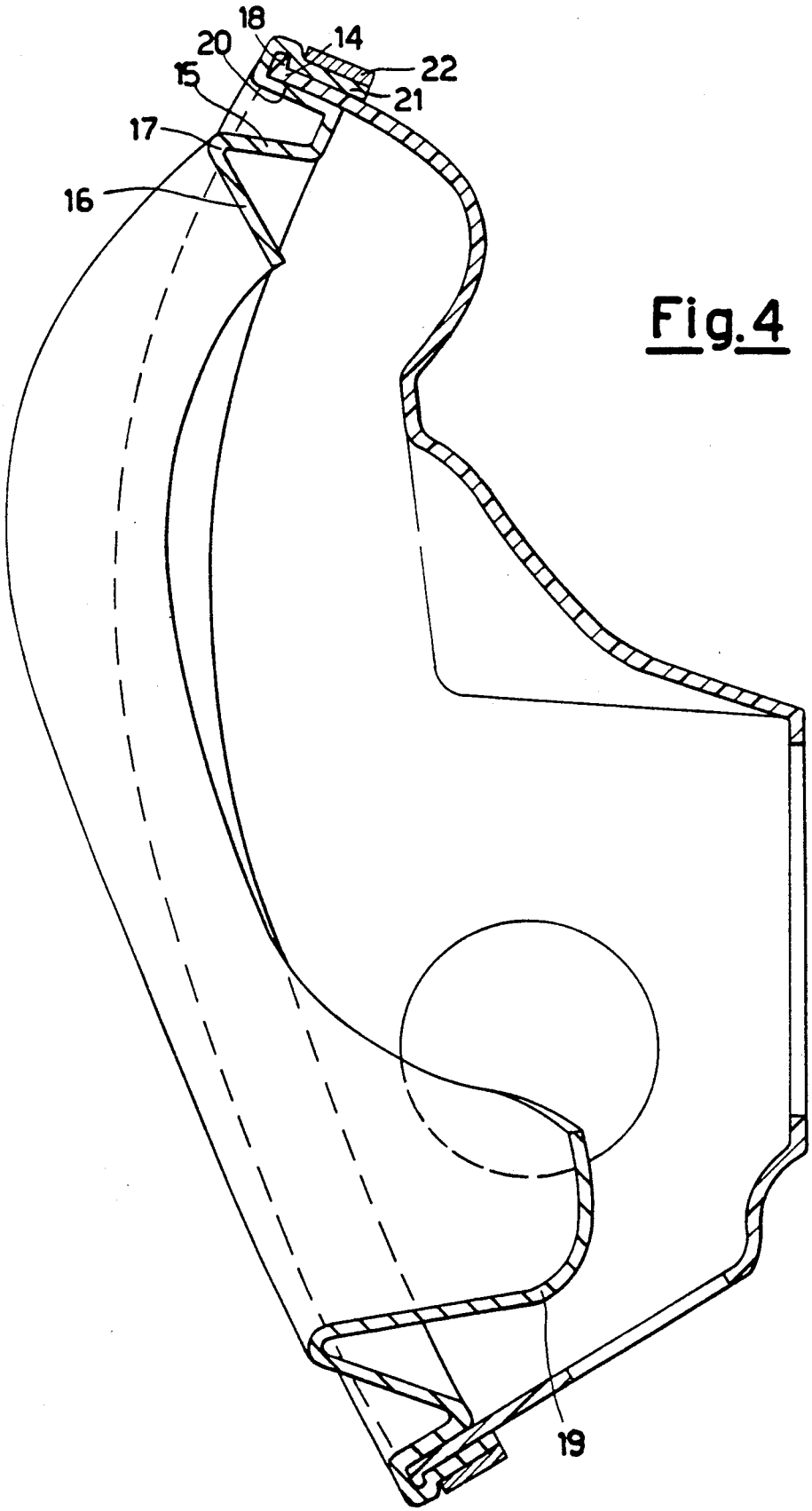
FIG. 4 is a cutaway view taken along line IV—IV of FIG. 1 in which just the face-shield and the seal have been represented by easiness.

With particular reference to the above mentioned figures the mask according to the present invention, generally indicated as 1, comprises a face-shield 2 which is the supporting structure of all operational means interfacing to the outside world which are needed by the mask to operate in the right way while put the user's face.

The face-shield 2 is made by a strengthened technopolymer having the characteristics of stiffness, resilience and transparency. Said face-shield 2 includes in a single piece also the ocular surface 12 allowing a particularly wide field of view.

The shape of the face-shield 2 is such that it protects the whole face following its lineaments without interference.

The ocular surface 12 is flat and shaped as a frontal of spectacles, slightly reentrant compared to the face-shield. While the mask is put on, the ocular surface 12 is disposed in front of the user's eyes in a position substantially coincident with that usually foreseen for optical lenses.

The means for fitting of the mask 1 to the user's head act directly on the face-shield 2. Said means include elastic belts 4 adjustable in length by buckles 10. The perimetric edge 14 of the face-shield 2 is shaped to be sealed to the user's face (not shown) by the interposition of means for adjusting the tightness. Said means include a seal made from antiallergic rubber which presents a bellows section whose softness and compliance are such that they guarantee a perfect tightness face-mask and at the same time a very good comfort. Said bellows includes a first (15) and a second (16) concentric annular foil or a sealing strip joined together along a hinge line 17.

The first foil 15 is integral with the means for the fit of the seal to the perimetric edge of the face-shield, whereas the second foil 16, which meets operationally the user's face, carries a chin-latch 19. The means for the fit of the seal to the perimetric edge 14 of the face-shield include a first internal flap 20 and a second external flap 21 joined together to form an U-shaped structure or a channel surrounding the edge 14 which is provided with a step 18.

A metallic hooping 22 presses the external flap 21 against the edge 14.

The operational means interfacing to the outside world include two separate fittings for filters 5, a non-return valve for exhaling 7, a central filler 8 for the food feeding, placed coaxial to a phonic device 9. Each fitting 5 is provided with a non-return valve for inhaling 6. Said inhaling valve 6 allows the inlet of the flow of inhaled air, purified by a traditional filter (not shown)

screwed on the fitting 5, into the mask. The exhaled air flow leaves the interior of the mask by means of the non-return valve for exhaling 7. A small oronasal mask 13 made from soft and flexible material (e.g. surgical grade silicone rubber) is fitted to the body of the central filler 8. Said small mask 13 holds the nose and the mouth of the user, canalizes and limits the dispersion of the air flow coming in and going out of the mask and particularly prevents the outcoming flow which is particularly full of humidity from clouding the ocular surface. Moreover the small oronasal mask 13 favors the convergence of the sounds into the phonic device 9 improving its efficency.

What is claimed is:

1. A protective mask comprising:

an outer one-piece face shield having a front wall adapted to overlie the wearer's face and a peripheral edge which when the mask is secured to the wearer's head fits over the forehead and cheeks and under the chin of the wearer and extends rearwardly, said face shield being formed of rigid material at least an ocular portion of which is transparent for providing the wearer a wide field of view;

means for resiliently sealing said face shield to the face of the wearer comprising a unitary structure in the form of an annular development having an outer edge the contour of which corresponds to the contour of the peripheral edge of said face shield and an inner edge, wherein the outer edge of said face sealing structure is detachably secured to said face shield with a peripheral hoop cooperatively with a step formed on said face shield along the peripheral edge, said structure having a channel at said outer edge in which the peripheral edge of said face shield is received for sealing said face shield to said sealing means, an annular-shaped sealing strip surrounding the inner edge, and compressible bellows means interposed between said channel and said face sealing strip for resiliently adjusting the tightness of the seal between the face sealing strip and the face of the wearer; and means for securing said face shield to the head of the wearer comprising a plurality of elastic belts each secured at one end to said face shield and interconnected at the other end and arranged to fit over the back of the head of the wearer for supporting the load of said face shield and any attachments thereon without affecting said face sealing means other than to comfortably maintain the tightness of the seal between the face sealing strip and the face of the wearer, and wherein said one end of said belts are attached to said peripheral hoop at spaced locations therearound.

2. A protective mask according to claim 1, wherein said bellows means comprises first and second concentric annular-shaped baffles joined together at respective first edges along a hinge line and which diverge to form an angle therebetween having concavity toward said face shield, and wherein said first baffle is integrally joined along a second edge to a portion of said structure which forms said channel and said second baffle comprises said face sealing strip.

3. A protective mask according to claim 1 or claim 2, wherein a portion of said second annular-shaped baffle extends toward said face shield to form an integral chin latch arranged to fit under the chin of the wearer.

4. A protective mask according to claim 1, wherein said belts are individually adjustable in length.

5. A protective mask according to claim 1, wherein said mask further comprises:

a small inner oronasal mask having a tubular connecting portion supported in and extending through an opening in said face shield adapted to be connected to a respirator for inhaling and exhaling therethrough, said oronasal mask being formed of surgical grade silicone rubber and of a size to overlie the nose, mouth and chin of the wearer.

6. A protective mask according to claim 1, wherein said unitary structure for sealing said face shield to the face of the wearer is formed of anti-allergic rubber and comprises in order from said outer edge (a) outer and inner spaced, substantially parallel flaps joined together and forming a U-shaped channel in which the peripheral edge of the face shield is received;

(b) a first annular-shaped baffle joined at a first edge to said inner flap along a first hinge line and extending inwardly therefrom; and (c) a second annular-shaped baffle hingedly connected to a second edge of said first baffle along a second hinge line and arranged to form an angle between said first and second baffle having concavity toward said face shield.

* * * * *

UNITED STATES PATENT AND TRADEMARK OFFICE

CERTIFICATE OF CORRECTION

PATENT NO. : 5,080,092

DATED : January 14, 1992

INVENTOR(S) : Giovanni M. Tenna

It is certified that error appears in the above-identified patent and that said Letters Patent is hereby corrected as shown below:

Title page, Item 30, "Aug. 4, 1937" should read --Aug. 4, 1987--;

Title page, 2nd column, 7th line, "Spriomask" should read --Spiromask--;

Column 1, line 8, "to" should read --to a--;

Column 1, line 41, "shows" should read --has--;

Column 3, line 31, "cooperatively" should read --cooperating--.

Signed and Sealed this

Twentieth Day of July, 1993

Attest:

Michael K. Kirk

MICHAEL K. KIRK

Attesting Officer

Acting Commissioner of Patents and Trademarks